United States Patent [19]

Rogakos et al.

[11] Patent Number: 4,763,936

[45] Date of Patent: Aug. 16, 1988

[54] POWER OPERATED DOOR LATCH

[75] Inventors: Deno J. Rogakos; Joseph P. Licata, both of Dayton, Ohio; John L. Sloan, Mt. Clemens, Mich.

[73] Assignee: General Motors Corporation, Detroit, Mich.

[21] Appl. No.: 920,651

[22] Filed: Oct. 20, 1986

[51] Int. Cl.[4] ..... E05C 3/26

[52] U.S. Cl. ..... 292/201; 292/216; 292/DIG. 23; 292/280

[58] Field of Search ..... 292/201, 216, 280, 336.3, 292/144; 70/279

[56] References Cited

U.S. PATENT DOCUMENTS

| | | | |
|---|---|---|---|
| 2,898,138 | 8/1959 | Van Noord | 292/122 |
| 2,943,880 | 7/1960 | Joachim et al. | 292/201 |
| 2,950,138 | 8/1960 | Meyer et al. | 292/229 |
| 3,359,767 | 12/1967 | Arlauskas et al. | 292/201 X |
| 3,504,511 | 4/1970 | Allen | 292/201 X |
| 4,033,616 | 7/1977 | Sheesley | 292/216 |
| 4,258,945 | 3/1981 | Pouget | 292/201 X |
| 4,272,112 | 6/1981 | Schlick et al. | 292/201 |
| 4,290,634 | 9/1981 | Gelhard | 292/201 |
| 4,452,058 | 6/1984 | Noel | 292/201 X |
| 4,569,544 | 2/1986 | Escaravage | 292/201 X |
| 4,586,737 | 5/1986 | Arlauskas | 292/216 |
| 4,588,217 | 5/1986 | Escaravage | 292/216 X |
| 4,624,491 | 11/1986 | Vincent | 292/216 X |
| 4,652,027 | 3/1987 | Quantz | 292/201 |

*Primary Examiner*—Gary L. Smith
*Assistant Examiner*—Eric K. Nicholson
*Attorney, Agent, or Firm*—Saul Schwartz

[57] ABSTRACT

An automobile door latch has a fork-type latch bolt, a detent lever which automatically retains the bolt in a closed-latched position in a manual-closed operating mode of the latch when the door is manually swung to the closed position, a manually actuated release lever which moves the detent lever to a releasing position releasing the bolt in a manual-open operating mode of the latch, and a power operating means which power rotates the bolt from an ajar-latched position to the closed-latched position in a power-closed operating mode of the latch and which moves the detent lever to the releasing position in a power-open operating mode of the latch. The door latch further includes an electrical control which automatically actuates the latch in the power-closed operating mode when the latch bolt achieves the ajar-latched position and which permits random sequencing of the manual and the power operating modes of the latch.

6 Claims, 4 Drawing Sheets

POWER OPERATED DOOR LATCH

BACKGROUND OF THE INVENTION

1. Field of the Invention

This invention relates generally to automobile door latches and, more particularly, to power operated door latches.

2. Description of the Prior Art

Power operated latches for automobile doors and deck lids assist vehicle users in closing doors and deck lids against seal pressure. In U.S. Pat. No. 2,950,138, a powered deck lid latch is described wherein a generally conventional latch bolt cooperates with a detent lever pivotally supported on an intermediate plate which, in turn, is pivotally mounted on the deck lid and driven in opposite directions through a predetermined arc by a reversible electric motor. When the deck lid is manually closed to where the lid just encounters the seals, the detent lever drops behind a shoulder on the bolt to retain the lid and also switches on the motor. The motor then drives the bolt to a latched position through the intermediate plate and the detent lever. In U.S. Pat. No. 2,898,138, a powered door latch is described wherein a multi-part latch bolt is pivotally supported on an intermediate plate which, in turn, is pivotally supported on the door. When the door is manually closed to where the seals are just encountered, the bolt contacts and retains a striker and switches on a non-reversible electric motor. The motor rotates a cam which engages the intermediate plate and pivots the latter in a direction causing the bolt to pull the door to a closed position. The striker is manually released from the bolt for door opening and the bolt then switches on the motor to rotate the cam during which rotation the cam profile returns the intermediate lever to its original position. A power operated door latch according to this invention has powered modes for door closing and door opening, manual modes for door opening and closing, and a manual override mode for door opening and represents an improvement over the above-described latches.

SUMMARY OF THE INVENTION

The power operated door latch according to this invention has fully independent manual and power operated modes for both door opening and door closing and a manual override mode for door opening. In addition, the manual and powered modes are fully compatible so that the powered and manual modes may be randomly sequenced.

In the manual-close mode, a fork-type latch bolt ("fork bolt" hereinafter) pivoted on the door engages a striker and is rotated thereby all the way to a closed-latched position. A spring biased detent lever engages and holds the fork bolt in the closed-latched position. In the manual-open mode, the detent lever is manually pivoted to release the fork bolt so the door can swing open.

In the power-close mode, after the door is manually swung to an ajar position just engaging the door seals and pivoting the fork bolt to an ajar-latched position, the detent lever prevents movement of the fork bolt in the opposite direction and a switch responsive to the position of the fork bolt switches on a non-reversible electric motor. The motor rotates an output gear through less than 360° from a first parked position corresponding to the door being open ("open-parked position" hereinafter) to a second parked position corresponding to the door being fully closed ("closed-parked position" hereinafter). The fork bolt has a sector of gear teeth thereon in mesh with the teeth of a sector gear on the door. A first clutch between the sector gear and the output gear operates when the output gear rotates from the open-parked position to the closed-parked position to connect the output gear to the sector gear whereby the fork bolt is driven from the ajar-latched to the closed-latched position. In the power-open mode, the motor is switched on to rotate the output gear through the remainder of 360° from the closed-parked position back to the open-parked position during which rotation the output gear causes the detent lever to release the fork bolt so the door can swing to the open position, the detent lever being held away from the fork bolt for a duration sufficient to avoid relatching the fork bolt in the ajar-latched position as the door opens.

In the manual override mode a second clutch in series with the first clutch overrides the first clutch when the output gear is between the open-parked and the closed-parked positions in the door opening direction if the motor should stop. In the manual override mode, the second clutch, normally always engaged, between the output gear and the sector gear is manually actuated to release the sector gear from the output gear simultaneously with manual release of the detent lever from the fork bolt.

DESCRIPTION OF THE PREFERRED EMBODIMENT

Figure 1:
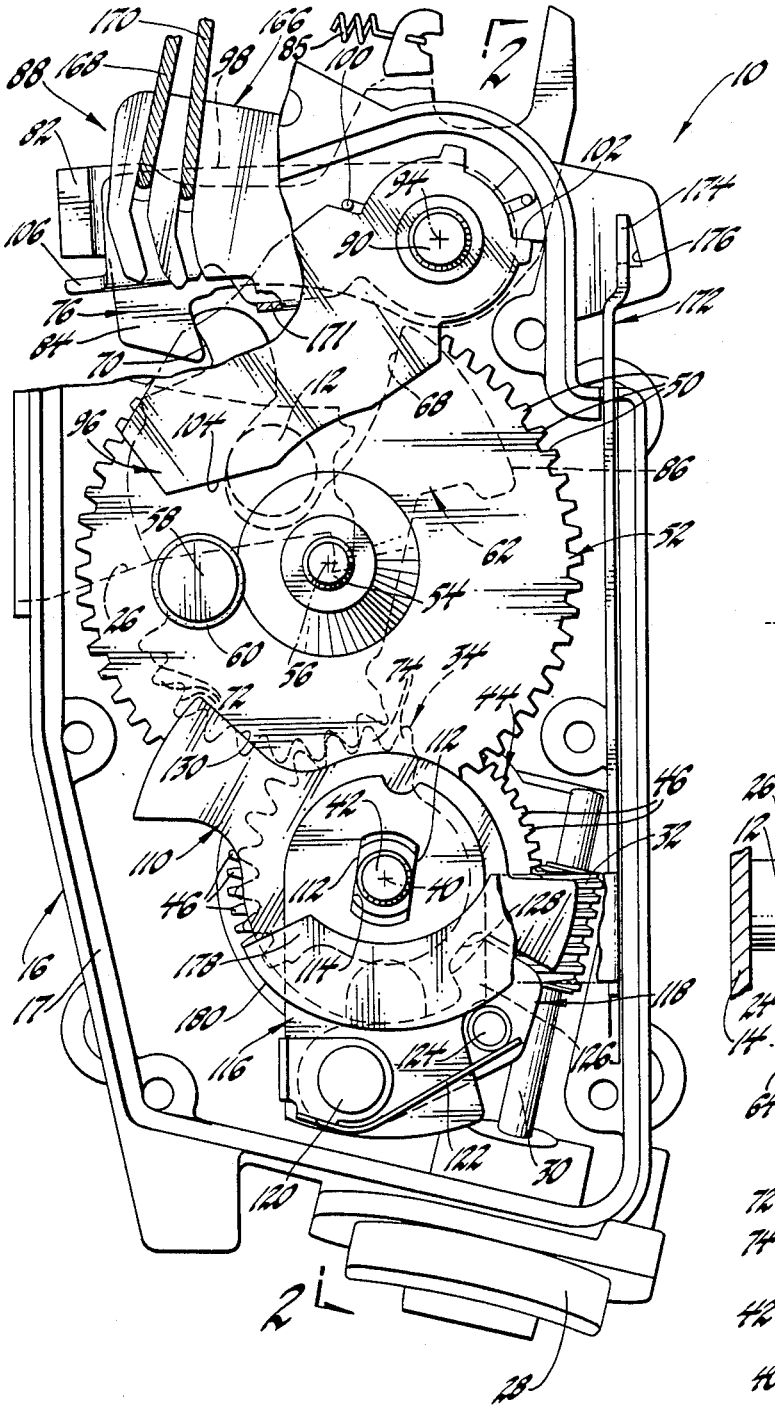
FIG. 1 is a fragmentary elevational view, partly in section, of a power operated door latch according to this invention.
Figure 2:
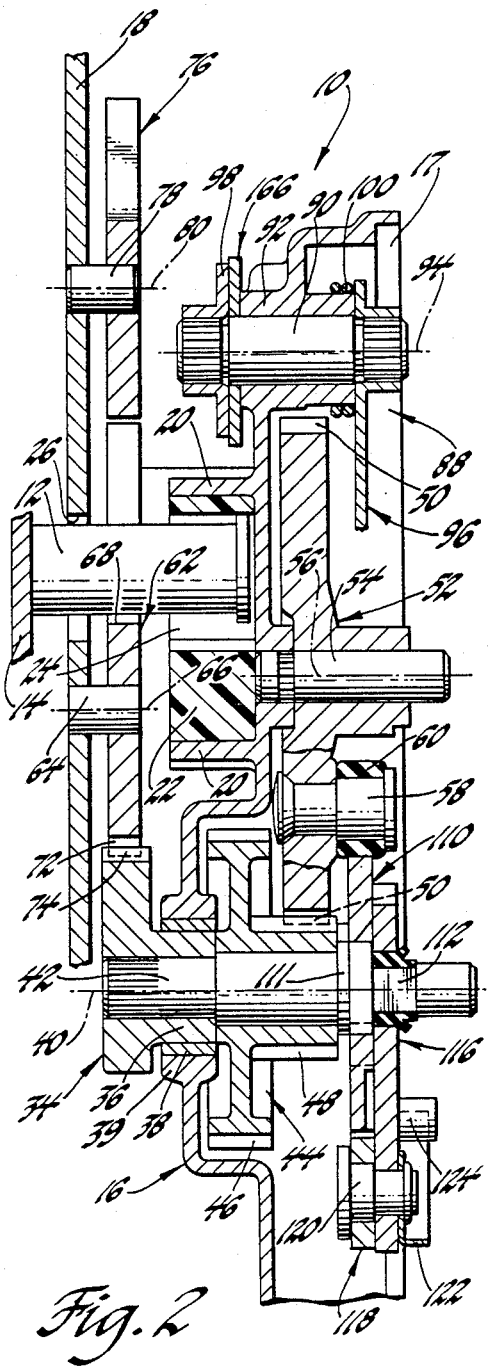
FIG. 2 is a sectional view taken generally along the plane indicated by lines 2—2 in FIG. 1.

Referring now to FIGS. 1 and 2 of the drawings, a power operated door latch 10 according to this invention is conventionally located at the rear vertical edge of a vehicle door, not shown, swingable between open and closed positions relative to a door opening in the vehicle body. A continuous elastomeric seal, not shown, disposed on the vehicle body around the door opening, is compressed between the door and the body in the closed position of the door. During closing movement, an ajar position of the door is defined and corresponds generally to the position of the door when the seal is first contacted. To maintain the door in either the ajar or the closed positions, the door latch 10 cooperates with a cylindrical striker pin 12 projecting horizontally into the door opening from a panel 14 defining a portion of the rear vertical edge of the door opening.

The door latch 10 includes a main housing 16 having an open side 17. A bolt housing, not shown, is rigidly attached to the main housing on the side thereof opposite the open side 17. The main housing 16 and the bolt housing are rigidly mounted on the door in the interior thereof such that a vertical wall 18 of the bolt housing is perpendicular to the striker 12 in the closed position of the door. The main housing 16 includes a flange 20 lined with an elastomeric bumper 22 which defines a pocket 24. The pocket 24 opens toward the left, FIG. 1, and registers with a slot 26 in the vertical wall 18 which also opens toward the left. The pocket 24 and the slot 26 permit movement of the striker 12 into and out of the door latch 10 as the door moves between the open and closed positions.

With continued reference to FIGS. 1 and 2, the door latch 10 further includes a motor housing 28, partially illustrated in FIG. 1, rigidly attached to the lower portion of the main housing 16. A non-reversible electric motor, not shown, is disposed in the housing 28 and rotates a worm gear shaft 30 with a worm gear 32 thereon. A sector gear 34 has a hub portion 36 journaled in a bearing 38 on a boss 39 of the main housing 16 whereby the sector gear is rotatable about a first axis 40. A sector shaft 42 is pressed into a bore in the hub portion 36 of the sector gear and rotates as a unit with the latter about the axis 40. A worm wheel 44 is rotatably supported on a central portion of the sector shaft 42 and includes an outer array of gear teeth 46 meshing with the worm gear 32 on the shaft 30 whereby the worm wheel rotates about the axis 40 when the worm gear shaft 30 rotates.

The worm wheel 44 further includes an inner array of gear teeth 48 which mesh with gear teeth 50 on an output gear 52. The output gear is supported on a pin 54 pressed into the main housing 16 and rotates about a second axis 56 parallel to the first axis 40. A drive pin 58 is rigidly supported on the output gear 52 and orbits in a circle about the axis 56 when the output gear rotates. The pin 58 has a roller 60 rotatably supported therein.

Figure 3:
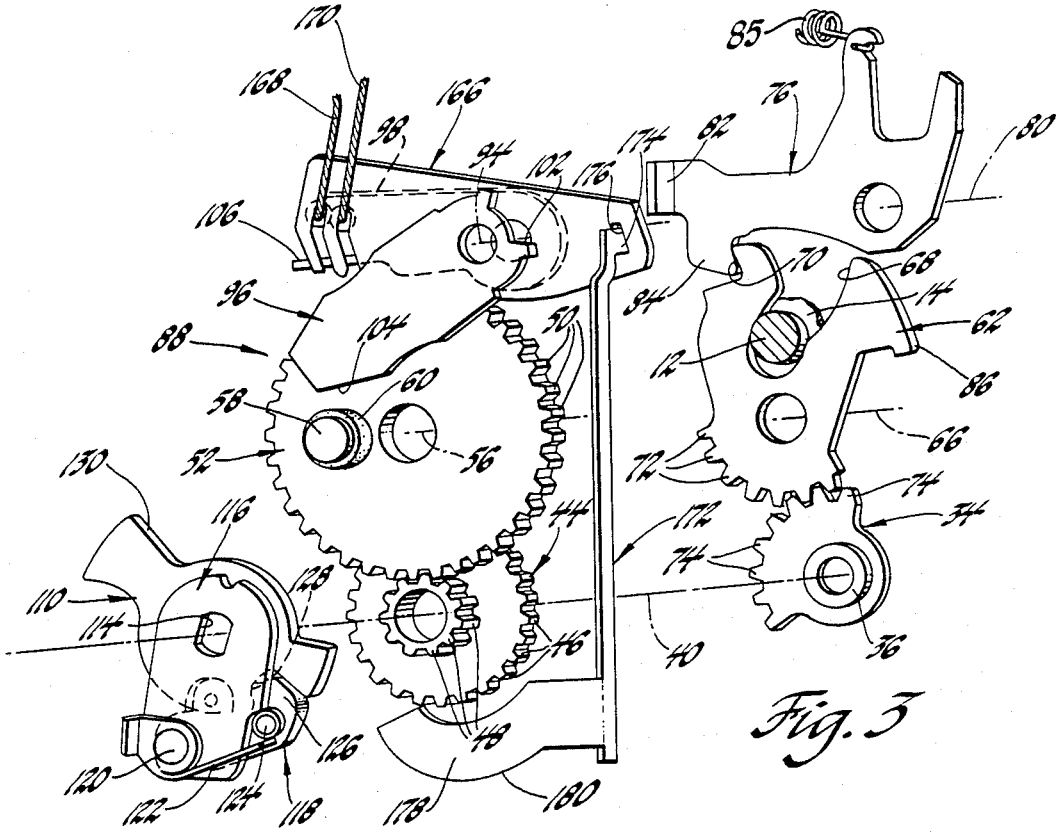
FIG. 3 is an exploded perspective view of selected elements of the power operated door latch in relative positions corresponding to the closed-latched position of the fork bolt.
Figure 4:
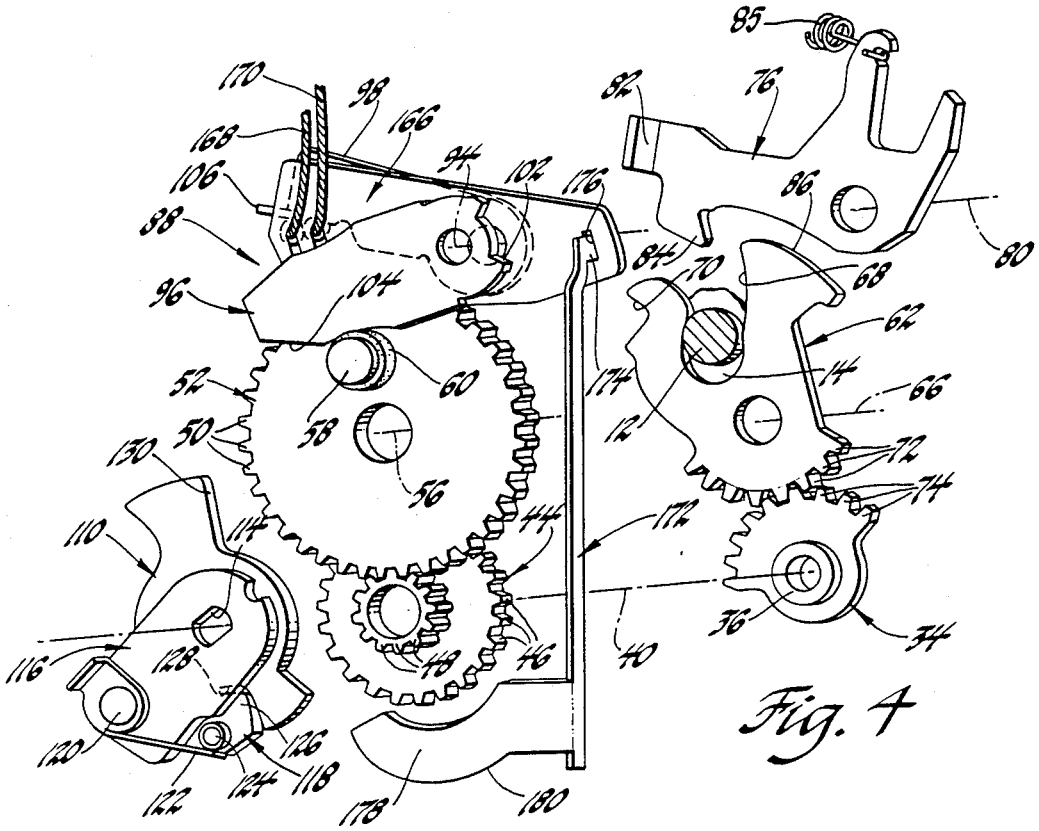
FIG. 4 is similar to FIG. 3 but showing the selected elements in relative positions corresponding generally to unlatching the fork bolt.
Figure 5:
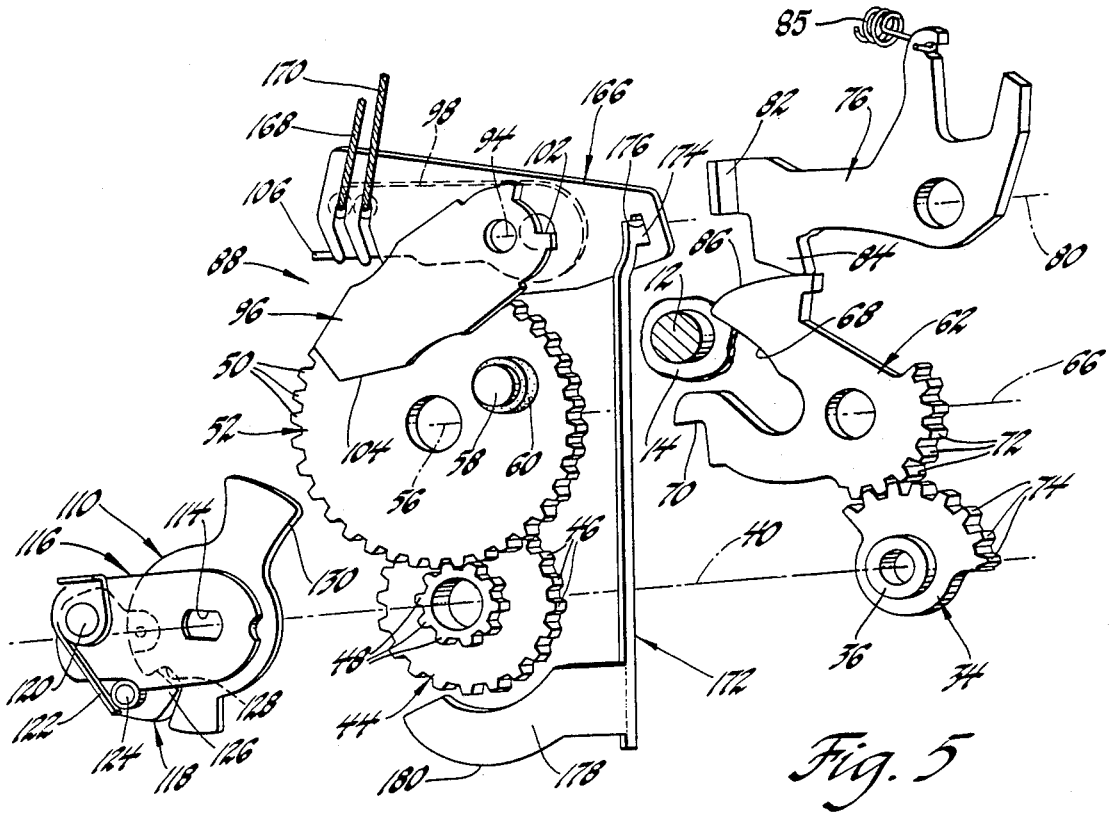
FIG. 5 is similar to FIG. 3 but showing the selected elements in relative positions corresponding to the unlatched position of the fork bolt.

A fork bolt 62 is supported on a pin 64 rigidly attached to the vertical wall 18 for pivotal movement about a third axis 66 between an unlatched position, FIG. 5, corresponding to the open position of the door, and a closed-latched position, FIG. 3, corresponding to the closed position of the door. Between the unlatched and closed-latched positions, the fork bolt 62 has an ajar-latched position corresponding to the ajar position of the door, the ajar-latched position of the fork bolt being illustrated in FIG. 4. The fork bolt 62 includes a throat 68 which receives the striker pin 12, a detent surface 70 and an array of sector gear teeth 72 which mesh with an array of gear teeth 74 on the sector gear 34.

A spring, not shown, biases the fork bolt toward the unlatched position. A detent lever 76 is supported on a pin 78, FIG. 2, rigidly attached to the vertical wall 18 for rotation about a fourth axis 80 between a detenting position, FIGS. 1 and 3, and a releasing position, FIGS. 4 and 5. The detent lever has a lifting flange 82, FIGS. 3, 4 and 5, perpendicular to the plane of the main portion of the lever and a hook 84. A spring 85, FIGS. 1 and 3–5, between the main housing and the detent lever biases the detent lever counterclockwise toward the detenting position. In the unlatched position of the fork bolt, FIG. 5, the hook 84 rests on a peripheral edge 86 of the bolt. In the ajar-latched position of the bolt, the hook 84 engages the upper edge of the throat 68 and prevents rotation of the bolt from the ajar-latched position to the unlatched position. In the closed-latched position of the bolt, FIGS. 1 and 3, the hook 84 engages the detent surface 70 and prevents the bolt from rotating out of the closed-latched position. With the fork bolt 62 in either the ajar-latched or the closed-latched position, movement of the detent lever 76 to the releasing position releases the bolt for counterclockwise rotation to the unlatched position, FIG. 5.

A release lever assembly 88 of the door latch includes a lever shaft 90 supported in a boss 92 of the main housing 16 for rotation about a fifth axis 94, a release operating lever 96 rigidly attached to one end of the lever shaft 90 and a detent release lever 98 rigidly attached to the other end of the shaft 90 on the opposite side of boss 92. A spring 100, FIG. 2, between the release operating lever 96 and the main housing 16 biases the release lever assembly counterclockwise to an inactive position, FIGS. 1, 3 and 5, defined by engagement of a shoulder 102, FIG. 1, of the release operating lever 96 on a fixed stop on the main housing 16. In the inactive position of the release lever assembly, an edge 104 of the release operating lever 96 intersects the circular orbit traversed by the drive pin 58 on the output gear 52. Also, in the inactive position of the release lever assembly, a lifting finger 106 projecting from the end of the detent release lever 98 underlies and is separated from the flange 82 on the detent lever 76, FIG. 1. Because the release operating lever intersects the orbit of the drive pin 58 when the output gear rotates, the roller 60 on the pin 58 engages the edge 104 of the lever 96 and rotates the release lever assembly 88 clockwise causing the lifting finger 106 to engage the flange 82 on the detent lever 76 whereby the detent lever rotates clockwise from the detenting position to the releasing position.

A drive lever 110 is rotatably supported on the sector shaft 42 outboard of the worm wheel 44 and is separated from the latter by a flange 111 of the sector shaft 42. The end of the sector shaft 42 outboard of the drive lever 110 has flats 112 milled thereon at a predetermined angular relationship to the array of gear teeth 74 on the sector gear 34. A generally rectangular slot 114 in a pawl lever 116 is received over the milled flats 112 on the sector shaft whereby the pawl lever rotates as a unit with the sector shaft and with the sector gear 34. A pawl 118 is rotatably supported on a pin 120 rigidly attached to the pawl lever 116 and projecting perpendicular to the plane thereof. A spring 122 is disposed between the pawl lever 116 and the pawl 118 and engages a post 124 on the pawl whereby the pawl is biased counterclockwise about the pin 120 to a clutching position, FIGS. 1 and 3–5, wherein a hooked end 126 of the pawl seats in a notch 128 in the drive lever 110 to unite the drive lever and the pawl lever for unitary rotation. In the clutching position of the pawl, torque applied to the drive lever is transferred through the pawl and the pawl lever to the sector shaft 42. The drive lever 110 has an edge 130 engaged by the roller 60 on the drive pin 58 on the output gear 52 whereby torque is applied to the drive lever to rotate the sector shaft 42 and the sector gear 34 through the pawl lever 116 and the pawl 118. The drive pin 58, the roller 60, and the drive lever 110 form a first clutch between the output gear 52 and the sector gear 34. The pawl lever 116, the pawl 118, and the notch 128 on the drive lever form a second clutch in series with the first clutch between the output gear and the sector gear.

Operation of the electric motor is coordinated with the positions of the fork bolt 62 and the output gear 52 through an electrical circuit illustrated in FIGS. *7a–e.* Referring to FIG. *7a,* the electrical circuit includes a battery 132, a representative manual switch 134, and a printed circuit 136. The circuit 136 is mounted on a cover, not shown, over the open side 17 of main housing 16 and faces the output gear 52 and one end of the sector shaft 42. A schematically illustrated output gear switch arm 138 is rotatable as a unit with the output gear 52 about the axis 56 and sweeps over the printed circuit 136. A schematically illustrated fork bolt switch arm 140 disposed on the end of and rotatable with the sector shaft 42 about axis 40 likewise sweeps over another portion of the printed circuit 136. The position of the output gear switch arm 138 represents the position of the output gear 52. The position of the fork bolt switch arm 140 represents the position of the fork bolt 62 through the drive train defined by the sector gear teeth 72 on the fork bolt, the gear teeth 74 on the sector gear 34, and the sector shaft 42 rotatable as a unit with the sector gear. The output gear switch arm 138 carries an electrically conductive contact blade 142 having three contact pads 144 *a, b* and *c.* The fork bolt switch arm 140 has an electrically conductive blade portion at its distal end on which are disposed three contact pads 146*a, b* and *c.*

With continued reference to FIG. *7a,* the printed circuit 136 includes a power supply pad 148 with a C-shaped section 148*a* connected by a conductor 150 to the positive terminal of the battery 132 so that the pad 148 is continuously maintained at battery potential relative to ground. The printed circuit further includes a motor pad 152 extending generally around the periphery of the printed circuit with short and long arcuate sections 152*a* and 152*b* surrounding portions of the power supply pad section 148*a.* The printed circuit further includes a switching pad 154, a parking pad 156 and a holding pad 158. The parking pad 156 has a section 156*a* in the gap of the power supply pad section 148*a* and a section 156*b* in the same arc containing the motor pad sections 152*a* and 152*b.* The holding pad 158 has a section 158*a* disposed in the arc containing the motor pad sections 152*a* and 152*b* and the parking pad section 156*b.* The terminals of switch 134 are connected to a conductor 160 extending from the conductor 150 to the switching pad 154 whereby the switching pad is maintained at battery potential when the switch 134 is closed. The power supply terminals of the motor of the door latch are connected to a conductor 162 having one end in electrical contact with the motor pad 152 and the other end in contact with a ground pad 164 of the printed circuit maintained at ground potential.

In its power operated modes, the door latch 10 electrically closes and opens the door. Commencing with the door open, the latch elements normally assume the positions shown in FIGS. 5 and *7a.* In particular, the output gear 52 is in the open-parked position with the roller 60 on the drive pin 58 clear of both the release operating lever 96 and the drive lever 110 and the fork bolt 62 is in the unlatched position. In the electrical circuit, FIG. *7a,* the output gear switch arm 138 positions the blade 142 such that the pads 144*a* and 144*b* rest on the power supply pad section 148*a* while the contact pad 144*c* rests at the edge of holding pad section 158*a.* The fork bolt switch arm 140 is positioned such that the contact pad 146*c* rests on the motor pad 152 while the contact pads 146*a* and 146*b* rest on the parking pad 156. Since the parking pad 156 is not connected to the power supply pad 148, the worm shaft 30 is stationary.

The door is manually swung with little effort toward the closed position. As it approaches the door opening the striker 12 enters the throat 68 of the fork bolt 62, rotating the latter clockwise from the unlatched position, FIG. 5, to the ajar-latched position which is achieved in the ajar position of the door. As the fork bolt 62 rotates, the sector gear 34 and sector shaft 42 rotate counterclockwise therewith and backdrive the drive lever 110 to a position, FIG. 4, intersecting the circular orbit traversed by the roller 60 on the drive pin 58. The output gear, however, does not rotate since there is no drive connection between the output gear and the sector shaft 42. When the fork bolt achieves the ajar-latched position, the hook 84 of the detent lever drops into the throat 68 of the bolt thereby retaining the bolt in the ajar-latched position and the door in the ajar position.

In the electrical circuit, FIG. *7b,* during movement of the door from the open to the ajar position, the position of the output gear switch arm 138 is unchanged. The fork bolt switch arm 140, however, is driven by the fork bolt 62 to the position shown in FIG. *7b* wherein the contact pads 146*a* and 146*b* engage the holding pad 158. A circuit is thus completed from the power supply pad 148 to the motor pad 152 and the motor is switched on for a closing duration during which the output gear is rotated from the open-parked to the closed-parked position.

The rotating worm gear 32 rotates the output gear 52 clockwise from the open-parked position, FIG. 5, toward the closed-parked position, FIG. 3, causing the roller 60 on the drive pin 58 to engage the edge 130 of drive lever 110. The pin, through the roller, applies a force on the drive lever which rotates the sector shaft 42 and the sector gear 34 counterclockwise. The sector gear drives the fork bolt 62 clockwise from the ajar-latched position to the closed-latched position, FIG. 3. As the bolt 62 approaches the closed-latched position, the hook 84 of the detent lever 76 is cammed upward by the lower edge of the throat 68 and then drops behind the detent surface 70 to retain the bolt in the closed-latched position and the door in the closed position.

As the fork bolt is driven from the ajar-latched position to the closed-latched position, the door progressively compresses the door seals and encounters increasing resistance. An important feature of the door latch 10 is that the moment arm defined between the axis 40, about which the drive lever 110 rotates, and the point of contact between the drive lever and the roller 60 on the drive pin 58 increases as the bolt 62 approaches the closed-latched position. Accordingly, the torsional moment applied to the sector shaft 42 by the drive pin 58 through the roller 60 increases to compensate for the increasing seal resistance encountered by the door.

Figure 7A:
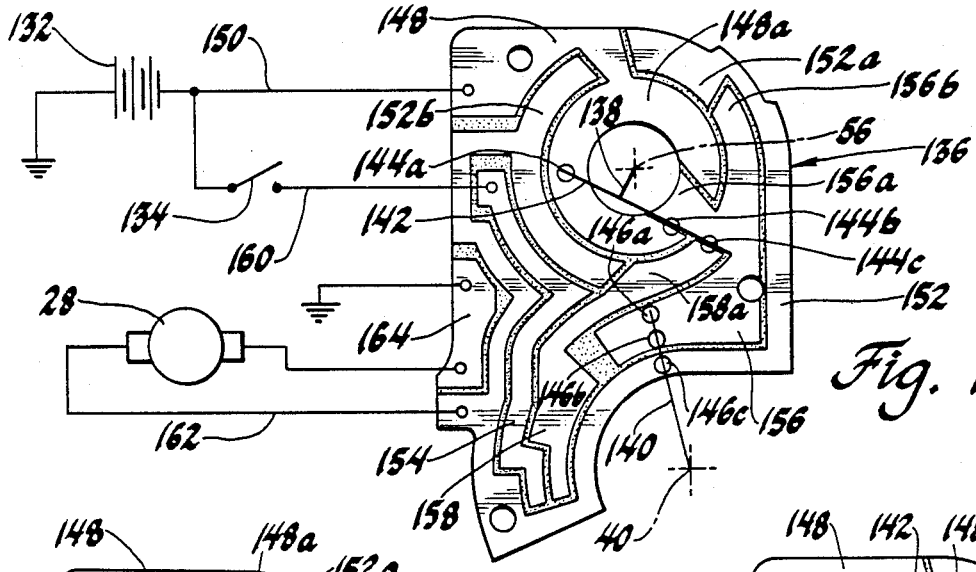
Figure 7B:
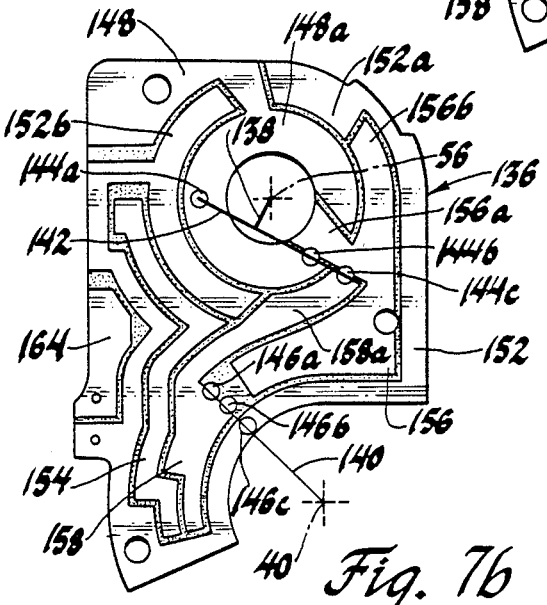
Figure 7C:
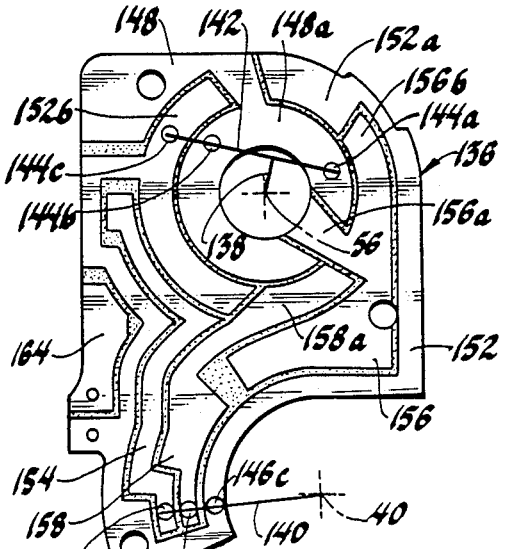
Figure 7D:
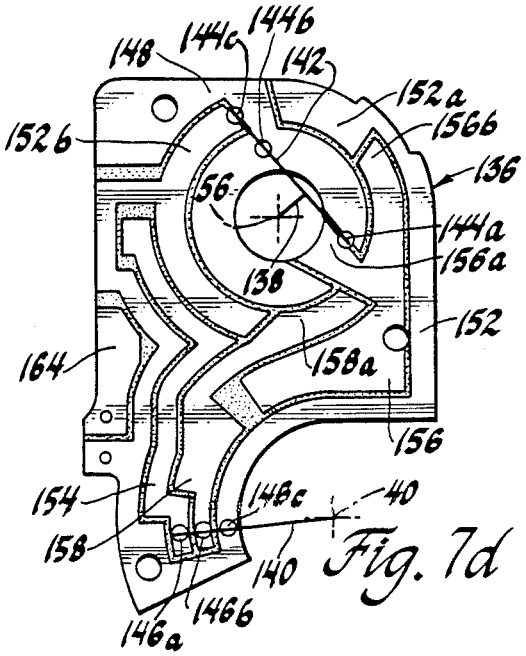

In the electrical circuit, when the motor 28 is switched on both the output gear switch arm 138 and the fork bolt switch arm 140 rotate from the positions shown in FIG. *7b* to the positions shown in FIGS. *7c* and *7d.* At the instant the contact pad 144*c* traverses the gap between the holding pad section 158*a* and the motor pad section 152*b,* motor control becomes independent of the position of fork bolt switch arm 140 so that the motor stays on until the contact pad 144*c* leaves the motor pad section 152*b*, FIG. 7*d*. The length of the motor pad section 152*b* is predetermined to hold the motor in the switched on condition for the door closing duration which lasts until after the fork bolt 62 achieves the closed-latched position. Thus, the drive pin 58 continues beyond the drive lever 110 to the closed-parked position, FIG. 3, wherein the pin and roller are completely clear of the arcuate path of movement traversed by the drive lever about the axis 40. When the fork bolt achieves the closed-latched position, the fork bolt switch arm 140 achieves the position shown in FIG. 7*c* with contact pad 146*a* on the switch pad 154, contact pad 146*b* on the holding pad 158 and contact pad 146*c* on the motor pad 152. Because the fork bolt does not move after the closed-latched position is achieved, the position of the fork bolt switch arm 140 is the same in FIGS. 7*c* and 7*d*.

Door opening in the power-open mode is initiated when an operator momentarily manually closes normally open switch 134 to complete a circuit from the battery 132 to the motor through the conductor 160, the contact pads 146*a* and 146*c*, the motor pad 152 and the conductor 162. Following momentary closure of the switch 134, the output gear rotates from the closed-parked position, FIG. 3, to an intermediate position, FIG. 4, between the closed-parked and the open-parked positions. During this movement, the roller 60 on the drive pin 58 engages the edge 104 of the release operating lever 96 and rotates the latter and the lever shaft 90 and the detent release lever 98 clockwise, FIG. 4. The lifting finger 106 engages the flange 82 on the detent lever 76 causing the latter to similarly rotate clockwise from the detenting position thereof to the releasing position. When the detent lever achieves the releasing position, the fork bolt 62 is released. With the fork bolt released, the door may be swung to the open position immediately or at the convenience of the operator. In either case, because the output gear dwells in the intermediate position, the detent lever 76 is maintained in the releasing position so that the fork bolt is free to rotate to the unlatched position.

Figure 7E:
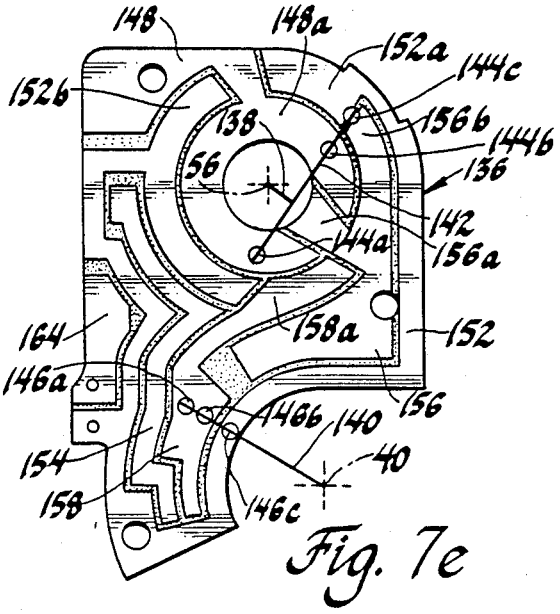

In the electrical circuit, the output gear switch arm 138 rotates when the switch 134 is momentarily closed. The neck of the power pad leading to the C-shaped section 148*a* is narrow so that the contact pad 144*c* quickly reaches motor pad section 152*a* whereupon control of the motor is independent of manual switch 134. The motor remains switched on as the output gear switch arm rotates from the position of FIG. 7*d* to the position of FIG. 7*e* corresponding to the intermediate position of the output gear. If the door has not been swung open beyond the ajar position, the fork bolt switch arm 140 is in either of its positions shown in FIGS. 7*d* and 7*e*. In that situation, when the contact pad 144*b* moves from the motor pad section 152*a* onto the section 156*b* of the parking pad, FIG. 7*e*, the motor stops with the output gear in the intermediate position because the parking pad 156 is not connected to the motor pad 152. The motor remains switched off until the door is swung open beyond the ajar position which movement causes the fork bolt to rotate toward the unlatched position thereof with corresponding movement of the fork bolt switch arm from the position of FIG. 7*e* back to the position of FIG. 7*a*. When the contact pads 146*a* and 146*b* reach the parking pad 156, the motor is once again switched on to rotate the output gear from the intermediate position toward the open-parked position. The motor is switched off in the open-parked position of the output gear when the contact pads 144*b* and 144*c* disengage from the parking pad section 156*a* onto the power pad section 148*a* and the holding pad section 158*a*, respectively. The interval between the time the motor is switched on in the closed-parked position of the output gear until the motor is switched off in the open-parked position of the output gear constitutes a door opening duration of motor operation.

Referring particularly to FIGS. 1–6, for operation in manual-open and manual-closed modes, the door latch 10 includes a manual release lever 166 rotatably supported on the lever shaft 90 between the detent release lever 98 and the boss 92 on the main housing 16. A pair of cables 168 and 170 are attached to the manual release lever and extend from the latter to inside and outside manual release means, not shown, on the door. For example, the cable 168 might be attached to a lock cylinder rotatable by a key inserted in the outside key slot on the door such that rotation of the key beyond a normal angle necessary to initiate operation in the power-open mode causes the cable 168 to pivot the manual release lever 166 clockwise about the lever shaft 90. The manual release lever 166 has a protruding flange 171, FIG. 1, which engages the lower edge of the detent release lever 98 and rotates the latter to the releasing position releasing the fork bolt and the door when one or the other of the cables is pulled. As the fork bolt rotates to the unlatched position, the sector shaft 42 rotates the drive lever 110 to the position shown in FIG. 5. Whether the output gear 52 is in the open-parked or closed-parked position is immaterial because the drive pin 58 and the roller 60 are remote from the drive lever in both positions. The sequence of events just described is reversed in the manual-closed mode which obtains when the door is swung closed with sufficient force to drive the fork bolt to the closed-latched position. Again, the drive pin 58 and roller 60 do not interfere with movement of the drive lever regardless of whether the output gear is in the open-parked or closed-parked position.

The manual and powered operating modes of the door latch can be randomly sequenced. If the door is manually closed after being powered open, the output gear switch arm 138 initially stays in the position shown in FIG. 7*a* while the fork bolt switch arm 140 assumes the position shown in FIG. 7*c*. In that condition the holding pad 158 is at battery potential and contact pad 146*a* on the fork bolt switch arm completes a circuit to the motor so that the motor is switched on to rotate the output gear and output gear switch arm to the position shown in FIG. 7*d*. If the door is manually opened after being powered closed, the output gear switch arm 138 initially stays in the position shown in FIG. 7*d* while the fork bolt switch arm 140 assumes the position shown in FIG. 7*a*. In that condition, the parking pad 156 is at battery potential and the contact pads 146*a* and 146*b* on the fork bolt switch arm complete a circuit to the motor so that the motor is switched on to rotate the output gear and output gear switch arm to the position shown in FIG. 7*a*.

Figure 6:
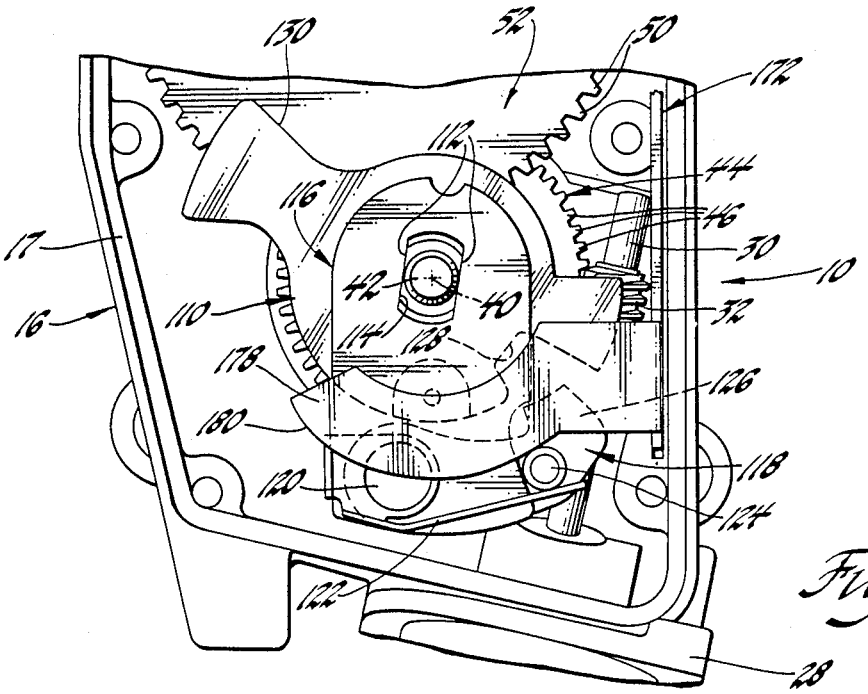
FIG. 6 is an enlarged view of a portion of FIG. 1 showing the second clutch for operation of the power operated door latch in the manual override mode; and FIGS. *7a–e* are a series of schematic diagrams of the electrical control circuit for the power operated door latch illustrating various operating states of the circuit.

As seen best in FIGS. 1 and 6, the door latch 10 has a manual override mode in the event that the motor stops while the roller 60 on the drive pin 58 is in engagement with the drive lever 110. To that end the door latch includes a pawl release bar 172 disposed on the main housing 16 for vertical reciprocation. The release bar includes an upper end 174 extending through a slot 176 in the manual release lever 166 so that when the manual release lever is pivoted clockwise by either of the cables, the pawl release bar 172 is depressed.

An integral foot 178 at the lower end of the pawl release bar 172 includes an arcuate edge 180 disposed between the axis 40 and post 124 on the pawl 118 when the pawl release bar is in a normal lifted position, FIG. 1. The post 124 does not engage the arcuate edge 180 when the sector shaft 42 rotates if the release bar is in the lifted position. In the event that the motor stops while the roller 60 on the drive pin 58 is exerting torque on the drive lever 110, however, tension on either of the cables 168 and 170 pivots the manual release lever 166 and simultaneously depresses the pawl release bar 172. The arcuate edge 180 engages the post 124 on the pawl and pivots the latter clockwise, FIG. 6, from the clutching position, FIG. 1, to an unclutching position, FIG. 6, wherein the hooked end 126 is removed from the notch 128 in the drive lever 110. At that instant the unit consisting of the pawl 118, the pawl lever 116, the sector shaft 42, the sector gear 34 and the fork bolt 62 become freely rotatable relative to the remainder of the door latch elements so that the fork bolt 62 is freely rotatable to the unlatched position.

The pawl release bar 172 is depressed whenever the manual release lever is pivoted by the cables 168 and 170 in the manual-open operating mode. A spring, not shown, biases the drive lever 110 clockwise, FIGS. 1–6, and insures that the drive lever will automatically follow the pawl lever 116 and the pawl 118. Referring to FIG. 1, for example, if the latch is actuated in the manual-open mode, the detent lever 76 and the pawl 118 simultaneously rotate to release the fork bolt 62 and the drive lever 110, respectively. The pawl lever 116 is then driven clockwise by the sector gear 34 independently of the drive lever 110. However, because the drive lever is unobstructed, the spring acting thereon causes it to rotate clockwise with the drive lever so that when the pawl release bar returns to the lifted position, the hook portion 126 on the pawl reenters the notch 128 in the drive lever 110.

The embodiments of the invention in which an exclusive property or privilege is claimed are defined as follows:

1. In combination with a vehicle door swingable on a vehicle body between an open position and a closed position in a door opening in said body and a striker on said body projecting into said door opening, a door latch comprising:

a latch bolt on said door rotatable between unlatched, ajar-latched and closed-latched positions, said striker engaging said latch bolt during movement of said door to and from said closed position so that said latch bolt is always in said unlatched position when said door is open and in said ajar-latched position when said door is in said ajar position and in said closed-latched position when said door is in said closed position, detent means on said door having a detenting position engaging said latch bolt and retaining said latch bolt in either of said ajar-latched and said closed-latched positions and a releasing position permitting unobstructed rotation of said latch bolt to said unlatched position, spring means on said door biasing said detent means to said detenting position so that whenever said latch bolt achieves said closed-latched position said detent means achieves said detenting position whereby said door latch retains said door in said closed position in a manual-closed operating mode when said door is swung manually to said closed position, manual release means on said door selectively operable to move said detent means from said detenting position to said releasing position whereby said door latch releases said door in a manual-open operating mode for opening movement from said closed position, a non-reversible electric motor on said door, automatic switch means on said latch responsive to the position of said latch bolt operative when said latch bolt achieves said ajar-latched position to switch on said motor for a predetermined door closing duration, first clutch means between said motor and said latch bolt operative to power rotate said latch bolt to said closed-latched position when said motor is switched on for said door closing duration whereby said door is closed in a power-closed operating mode of said door latch, manual switch means selectively operable to switch on said motor after said predetermined door closing duration, said automatic switch means being operative to thereafter switch off said motor after a predetermined door opening duration, and mechanical release means between said motor and said detent means operative to move said detent means to said releasing position during said door opening duration of motor operation whereby said door is opened in a power-open operating mode of said door latch, said automatic switch means being further operative to permit random sequencing of each of said power-open and said power-closed operating modes and said manual-open and said manual-closed operating modes.

2. The door latch recited in claim 1 wherein said first clutch means includes:

an output gear on said latch rotatable by said motor from an open-parked position to a closed-parked position when said motor is switched on for said door closing duration and from said closed-parked position to said open-parked position when said motor is switched on for said door opening duration, a drive pin on said output gear traversing a circular orbit during rotation of said output gear, means defining a plurality of sector gear teeth on said latch bolt, a sector gear rotatably disposed on said latch engaging said latch bolt sector gear teeth, and a drive lever rotatable as a unit with said sector gear, said sector gear and said latch bolt sector gear teeth cooperating to locate said drive lever in intersecting relation to said drive pin circular orbit when said latch bolt is in said ajar-latched position so that said drive pin engages and rotates said drive lever to a position corresponding to said closed-latched position of said latch bolt during rotation of said output gear from said open-parked to said closed-parked position.

3. The latch bolt recited in claim 2 wherein said automatic switch means includes:

a first switch arm controlled by said latch bolt having a plurality of contact pads, a second switch arm controlled by said output gear having a plurality of contact pads, and electrical printed circuit means on said latch engaged by each of said first switch arm contact pads and by each of said second switch arm contact pads.

4. The door latch recited in claim 3 wherein said mechanical release means includes:

a release operating lever rotatably disposed on said latch, and means connecting said release operating lever to said detent means for movement as a unit therewith, said release operating lever being located in an inactive position intersecting said drive pin circular orbit when said detent means is in said detenting position, and said drive pin engaging said release operating lever and moving said release operating lever to an active position corresponding to said detent means releasing position when said motor is switched on for said door opening duration.

5. The door latch recited in claim 4 further including:

a second clutch means between said latch bolt and said drive lever normally engaged to drivingly connect said drive lever to said latch bolt, and manual operating means connected to said second clutch selectively operable to disengage said second clutch and thereby disconnect said latch bolt from said drive lever when said drive pin is engaged on said drive lever.

6. The door latch recited in claim 5 wherein:

said second clutch includes a pawl lever between said drive lever and said latch bolt drivingly connected to said latch bolt, a pawl on said pawl lever rotatable relative thereto between an engaged position and a disengaged position, spring means biasing said pawl to said engaged position, means defining notch in said drive lever receiving a portion of said pawl in said engaged position thereof whereby said drive lever is drivingly connected to said latch bolt, and said manual operating means includes a pawl release bar supported on said latch for reciprocation between a lifted position and a depressed position, and a foot on said pawl release bar remote from said pawl in said lifted position of said release bar and engageable on said pawl to move said pawl to said disengaged position in said depressed position of said release bar.

* * * * *